United States Patent [19]

Reiter et al.

[11] Patent Number: 5,060,496

[45] Date of Patent: Oct. 29, 1991

[54] PROCEDURE FOR PRODUCING COIL-FORMING TUBES IN AN INERT ENVIROMENT

[75] Inventors: Karl Reiter, Leoben; Nobert Köck, St. Peter-Freienstein; Rainer Wahn, Leoben, all of Austria

[73] Assignee: Voest-Alpine Stahl Donawitz Gesellschaft m.b.H., Leoben-Donawitz, Austria

[21] Appl. No.: 401,413

[22] Filed: Sep. 1, 1989

[30] Foreign Application Priority Data

Sep. 16, 1988 [AT] Austria ..... 2277/88

[51] Int. Cl.[5] ..... B21B 9/00

[52] U.S. Cl. ..... 72/38; 72/364

[58] Field of Search ..... 72/38, 39, 364, 369, 72/700, 702

[56] References Cited

U.S. PATENT DOCUMENTS

| | | | |
|---|---|---|---|
| 3,257,835 | 6/1966 | Cofer et al. | 72/38 X |
| 3,613,421 | 10/1971 | Repper | 72/38 |

FOREIGN PATENT DOCUMENTS

| | | | |
|---|---|---|---|
| 229315 | 11/1985 | Fed. Rep. of Germany | 72/38 |
| 53-43661 | 4/1978 | Japan | 72/38 |
| 56-119615 | 9/1981 | Japan | 72/38 |
| 58-157543 | 9/1983 | Japan | 72/38 |
| 639623 | 12/1978 | U.S.S.R. | 72/38 |

OTHER PUBLICATIONS

Metals Handbook, vol. 4, 8th Edition (1977), p. 313.

*Primary Examiner*—Lowell A. Larson
*Assistant Examiner*—Michael J. McKeon
*Attorney, Agent, or Firm*—Cushman, Darby & Cushman

[57] ABSTRACT

A procedure for producing coil-forming tubes, in which the tubes are heated to a temperature of 1,000°–1,100° C., particularly to 1,050° C. and then bent at temperatures of more than 850° C. The method proceeds in such a way that the tubes are flushed with $N_2$ or an $N_2$ atmosphere is maintained during the heating and during the bending process, in order to increase the service life of such tubes.

6 Claims, No Drawings

PROCEDURE FOR PRODUCING COIL-FORMING TUBES IN AN INERT ENVIROMENT

BACKGROUND OF THE INVENTION

1. Field of the Invention

The invention relates to a procedure for producing coil-forming tubes, in which the tubes are heated to a temperature of 1,000–1,100° C., particularly to 1,050° C., and then bent at temperatures of more than 850° C.

2. Description of the Prior Art

In wire mills, particularly high-performance wire mills, the wire product with the desired end diameter is formed into coils in the run-out area, and depending on the requirements is subjected to a further cooling while more or less spread out. In order to form the wire material, which is running in at high speed, into coils, coil-forming tubes are used, which are naturally subjected to relatively high levels of wear.

For the production of such coil-forming tubes, a procedure was hitherto chosen in which the tubes were heated for about 2 minutes at temperatures between 1,200° and 1,250° C. in the soaking zone of a furnace, after which a bending process was carried out in suitable bending devices. Since the tubes are supposed to be scale-free internally, the bent tubes were cleaned internally by means of sand-blasting. The replacement of tubes was carried out depending on wear, and a tube is usually changed when the remaining wall thickness is about 2 mm. The initial wall thickness of such coil-forming tubes is usually as much as 8 mm. With such known tubes, service lives of about 5,000 to 7,000 t [metric tons] of wire were achieved. Subsequently, this known procedure was optimized by limiting the temperature of the forming tubes before bending to a maximum of 1,050° C., as a result of which it was possible to achieve an improvement in service life from 7,000 to about 15,000 t of wire.

SUMMARY OF THE INVENTION

The purpose of the invention is to increase the service life of such coil-forming tubes significantly. To perform this task, the procedure according to the invention essentially consists of having the tubes flushed with $N_2$ during the heating and during the bending process, or having an $N_2$ atmosphere maintained in the tube. As a result of the flushing with nitrogen or the maintenance of an $N_2$ atmosphere during the heating and during the bending process, scale formation can be prevented, and the sand-blasting that is usually required can be omitted. Surprisingly, however, it has turned out that flushing with $N_2$ during the heating and during the bending process almost doubles the service lives of the coil-forming tubes that are treated in this way, and when appropriate qualities are chosen for the tubes, it even increases the service lives manyfold. This effect, whose cause we have not been able to clarify fully, is surprising, and while keeping the same quality for the steel of the tubes, it has been possible with ease to achieve a service life of 30,000 t of wire compared to a previous maximum of 15,000 t.

DETAILED DESCRIPTION OF THE PRESENTLY PREFERRED EXEMPLARY EMBODIMENT

It is advantageous to carry out the procedure according to the invention in such a way that the $N_2$ flushing is maintained at least until the tube is taken off the bending device at a tube temperature of less than 450° C., and it is preferable if the heating is done to a maximum of 1,050° C. with $N_2$ flushing over a period of 15 to 25 minutes. All these measures have proven to be particularly advantageous with regard to increasing the service life of the tubes. The period between the heating and the start of the bending process has proven to be relatively critical for a marked increase of the service life, and it is particularly preferable to carry out the procedure of the invention in such a way that the bending process is performed with $N_2$ flushing or $N_2$ atmosphere in the tube at temperatures of more than 850° C. within 15 to 25 seconds--preferably 18 to 20 seconds--after removal from the furnace. Particularly when steels alloyed with chromium and molybdenum are used as the material for the tubes, it has been possible, when these parameters were satisfied, to achieve a significant increase of the service life.

In order to be sure of suppressing the formation of layers of scale, it is advantageous to carry out the procedure of the invention in such a way that following the bending process and before the removal from the bending die, a quenching in still air is performed over a period of about 20 minutes to a temperature of less than 450° C. with $N_2$ flushing The procedure of the invention is applied with advantage to special qualities of steel, and we obtain a particularly preferable execution of the procedure of the invention if we proceed by using for the tubes a steel with a guide analysis of 0.09%/wt to 1.00%/wt C, 0.01%/wt to 1%/wt Si, 0.01%/wt to 2.00%/wt Mn, and where appropriate up to 20%/wt Cr, up to wt Mn, up to 2%/wt V individually or jointly, the remainder Fe and production-related impurities, particularly of 0.2%/wt C, 0.4%/wt Si, 0.55%/wt Mn, max. 0.02%/wt P, max. 0.02%/wt S, 11.5%/wt Cr, 1.0%/wt Mo, 0.5%/wt Ni, and 0.3%/wt V, the remainder Fe. With such steels, which are known under the Material Number of 1.4922, an improvement in service life from the usual 10,000 t to as much as 30,000 t per year was already achieved earlier, we admit. However, by the application of the procedure of the invention to such qualities of steel with the Material Number of 1.4922, it has been possible to achieve a service life of more than 100,000 t, and in particular a service life of about 112,000 to 115,000 t of wire.

We claim:

1. A procedure for producing coil-forming tubes, said procedure comprising the steps of:

using a steel for at least one tube that has a guide analysis being 0.09%/wt to 1.00%/wt C, 0.01%/wt to 1%/wt Si, 0.01%/wt to 2.00%/wt Mn, with the remainder being Fe and production-related impurities;

heating the tube to a temperature of 1,000–1,100° C.;

bending the tube at temperatures of more than 850° C. on a bending device; and flushing the tube with $N_2$ to thereby maintain the tube in an $N_2$ atmosphere, during the heating and bending steps.

2. A procedure according to claim 1, wherein the flushing step is performed at least until the tube is taken off the bending device at a tube temperature of less than 450° C.

3. A procedure according to claim 1 or 2, wherein the heating step is done to a maximum of 1,050° C. and the flushing step is performed over a period of 15 to 25 minutes.

4. A procedure according to claim 1 or 2, wherein the bending step is performed with the flushing step occurring at a temperature of more than 850° C. within 15 to 25 seconds, preferably 18 to 20 seconds, after completion of the heating step.

5. A procedure according to claim 1 or 2, further comprising quenching the tube in still air over a period of about 20 minutes to a temperature of less than 450° C. before the tube is removed from the bending device, wherein the quenching step occurs while the flushing step is performed.

6. A procedure for producing coil-forming tubes, said procedure comprising the steps of:

using a steel for at least one tube that has a guide analysis being 0.09%/wt to 1.00%/wt C. 0.01%/wt to 1%/wt Si, 0.01%/wt to 2.00%/wt Mn, with the remainder being Fe and production-related impurities;

heating the tube to a temperature of no more than 1,050° C.;

bending the tube at temperatures of more than 850° C. on a bending device; and flushing the tube with $N_2$ during the heating and bending steps;

wherein the heating step is performed over a period of 15 to 25 minutes;

wherein the bending step is performed with the flushing step occurring at temperatures of more than 850° C. within 15 to 25 seconds after completion of the heating step; and wherein the flushing step is performed at least until the tube is taken off the bending device at a tube temperature of less than 450° C.

* * * * *